US012180811B2

(12) United States Patent
Roycroft et al.

(10) Patent No.: US 12,180,811 B2
(45) Date of Patent: Dec. 31, 2024

(54) LUBRICATOR WITH ORIFICE

(71) Applicant: Epic Lift Systems, Houston, TX (US)

(72) Inventors: Robert G. Roycroft, Houston, TX (US); Shannon S. Freeman, Tomball, TX (US); Aaron Michael Benjamin Skeete, Katy, TX (US)

(73) Assignee: Epic Lift Systems, Houston, TX (US)

( * ) Notice: Subject to any disclaimer, the term of this patent is extended or adjusted under 35 U.S.C. 154(b) by 0 days.

(21) Appl. No.: 18/179,297

(22) Filed: Mar. 6, 2023

(65) Prior Publication Data

US 2023/0287769 A1 Sep. 14, 2023

Related U.S. Application Data

(60) Provisional application No. 63/318,091, filed on Mar. 9, 2022.

(51) Int. Cl.
*E21B 43/12* (2006.01)
*E21B 33/068* (2006.01)
*F04B 47/12* (2006.01)

(52) U.S. Cl.
CPC ..... *E21B 43/12* (2013.01); *E21B 33/068* (2013.01)

(58) Field of Classification Search
CPC ..... E21B 43/121; E21B 43/127; F04B 47/12
USPC ..... 417/555.2, 57
See application file for complete search history.

(56) References Cited

U.S. PATENT DOCUMENTS

| | | | | |
|---|---|---|---|---|
| 2,018,206 | A * | 1/1935 | Fletcher | F04B 47/12 417/60 |
| 2,884,861 | A * | 5/1959 | Vincent | E21B 43/121 417/59 |
| 3,095,819 | A * | 7/1963 | Brown | F04B 47/12 251/65 |
| 4,923,372 | A * | 5/1990 | Ferguson | F04B 47/12 417/60 |
| 6,851,480 | B2 * | 2/2005 | Swoyer | E21B 43/121 166/372 |
| 7,337,854 | B2 * | 3/2008 | Horn | E21B 43/121 166/383 |
| 7,445,048 | B2 * | 11/2008 | Sheffield | E21B 47/01 166/250.15 |
| 9,850,731 | B2 * | 12/2017 | Maerz | E21B 43/121 |
| 11,208,874 | B2 | 12/2021 | Murdoch et al. | |
| 11,851,980 | B2 * | 12/2023 | Freeman | E21B 33/068 |
| 2006/0231149 | A1 | 10/2006 | Kulkarni | |
| 2015/0369022 | A1 | 12/2015 | Zhou | |
| 2017/0254787 | A1 | 9/2017 | Campanella et al. | |
| 2019/0234191 | A1 | 8/2019 | Murdoch et al. | |

* cited by examiner

*Primary Examiner* — Kenneth L Thompson
(74) *Attorney, Agent, or Firm* — Park, Vaughan, Fleming & Dowler LLP

(57) ABSTRACT

Described herein are embodiments of an improved bypass lubricator. The lubricator may include a body having a bore, where the bore may include at least an upper exit bore and a lower exit bore. The lubricator may also include an exit flow path that also has a bore, wherein the bore of the exit flow path is in fluid communication with the upper exit bore, the lower exit bore, and an exit valve. The upper exit bore and the lower exit bore may be sized relative to one another to create a pressure differential between the upper and lower exit bores to assist in maintaining an artificial lift device in the lubricator's body. Shutting the exit valve shuts in the well.

28 Claims, 18 Drawing Sheets

SECTION A-A

LUBRICATOR WITH ORIFICE

PRIORITY CLAIM

This application claims priority to provisional patent application Ser. No. 63/318,091 filed Mar. 9, 2022, which is fully incorporated herein by reference.

TECHNICAL FIELD

Embodiments of the subject matter disclosed herein relate to an improved bypass lubricator assembly with reduced valving and an orifice for controlling flow therein, and methods of operating and using the same.

DISCUSSION OF THE BACKGROUND

It is well known that production from oil and gas wells requires the diversion of produced materials at the wellhead. Various methods and devices have been developed for that purpose. The present invention assists in that process by, in one exemplary embodiment, providing an orifice for use in a reduced-valve bypass lubricator that overcomes prior art problems associated with such systems.

Those skilled in the art will be familiar with prior art lubricator designs. One prior art design consists of a lubricator having an upper exit and a lower exit, where a plunger (or other artificial lift device) is designed to be housed in the lubricator in spatial relation to the upper and lower exit, typically above the lower exit to promote flow from the well through the lower exit, i.e., without interference from the plunger. Each exit from the lubricator includes a valve for controlling flow from the exit. As is known, these valves can be adjusted in an effort to control the flow out of the lubricator so as to maintain the plunger in a desired position in the lubricator. In order to shut the well in, both valves had to be closed.

Another prior art lubricator design includes a built in flow block having an orifice and a single exit. Such designs do not include any valves in the flow block to control or otherwise maintain the plunger in the lubricator. As such, the plunger can and often does interfere with flow through the outlet of the flow block unless other methods are used to keep the plunger out of the flow path.

Those skilled in the art will appreciate that lubricator designs are constrained by existing API specifications and that any changes to a lubricator must conform to those specifications. Those skilled in the art will further appreciate that reducing the complexity and number of valves necessary for a lubricator presents a commercial and economical advantage. As such, the inventors of the present invention have developed a new bypass lubricator design that reduces the number of valves required by prior art designs, while still optimizing the maintenance/positioning of a plunger in the lubricator and while still complying with the pertinent API specifications.

The details of the present invention are described in more detail below via exemplary embodiments and in conjunction with the following Figures.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is later discussed.

Described herein are embodiments of systems and apparatuses that include an improved bypass lubricator assembly for use on a well. The lubricator may include a body having a bore through which gas from the well travels, where the bore includes at least an upper exit bore and a lower exit bore. The lubricator may also include an exit flow path that also has a bore, wherein the bore of the exit flow path is in fluid communication with the upper exit bore, the lower exit bore, and an exit valve. The upper exit bore and the lower exit bore may be sized relative to one another to create a pressure differential between the upper and lower exit bores to assist in maintaining an artificial lift device in the lubricator's bore. Shutting the exit valve shuts in the well.

BRIEF DESCRIPTION OF THE DRAWINGS

The following disclosure may be understood by reference to the following description taken in conjunction with the accompanying drawings, in which like reference numerals identify like elements. The accompanying drawings, which are incorporated herein and constitute a part of the specification, illustrate one or more exemplary embodiments of the present invention, except where the drawings are indicated to illustrate the prior art. In the drawings.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such special definition will be expressly set forth in the specification in a definitional manner that directly and unequivocally provides the special definition for the term or phrase.

Figure 1:
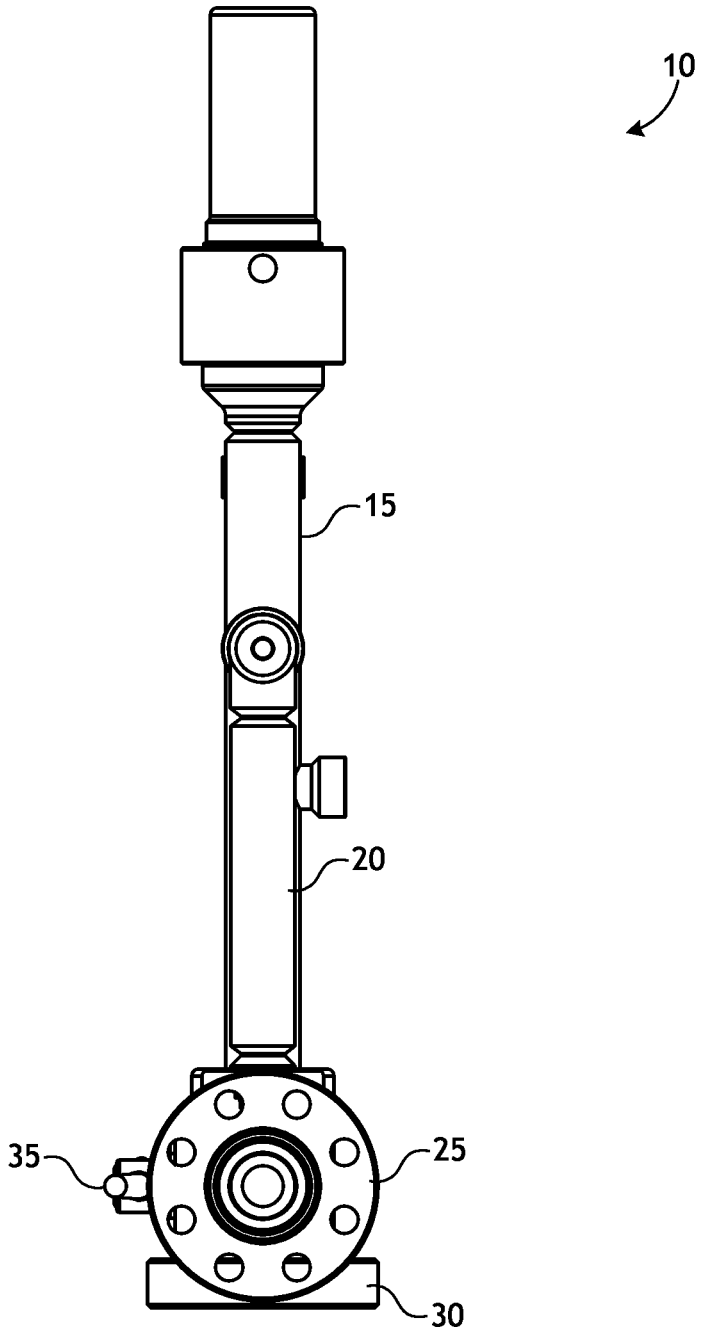
FIG. 1 is a front view of one embodiment including the present invention.
Figure 2:
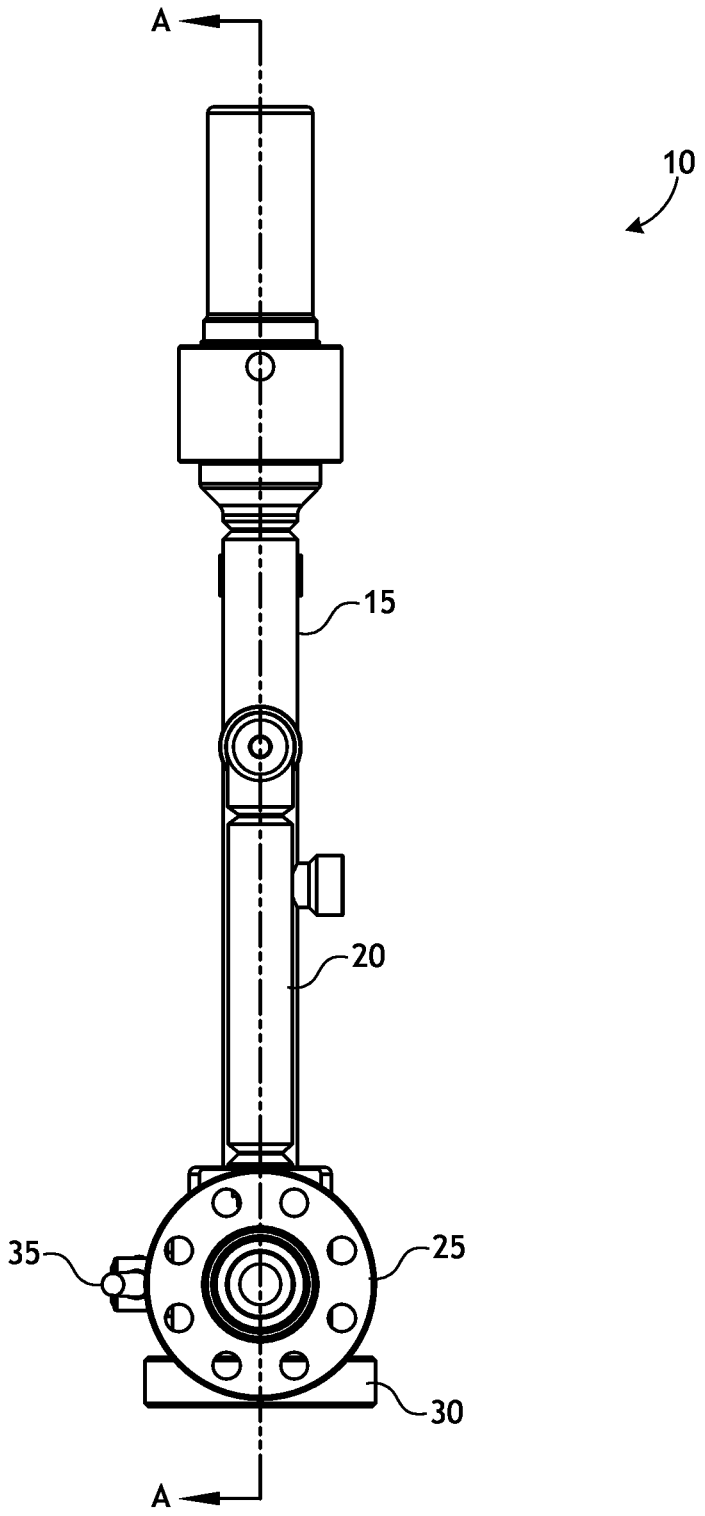
FIG. 2 is a front view of one embodiment including the present invention, further showing a cross section line A-A.

The present exemplary embodiments describe an improved bypass lubricator assembly. For example, FIG. 1 is a front view of one embodiment including the present invention, whereas FIG. 2 is the same view but further showing cross section line A-A. The principle components of the improved lubricator 10 may include body 15, exit flow path 20, outlet flange 25, inlet flange 30 and exit valve 35.

Figure 3:
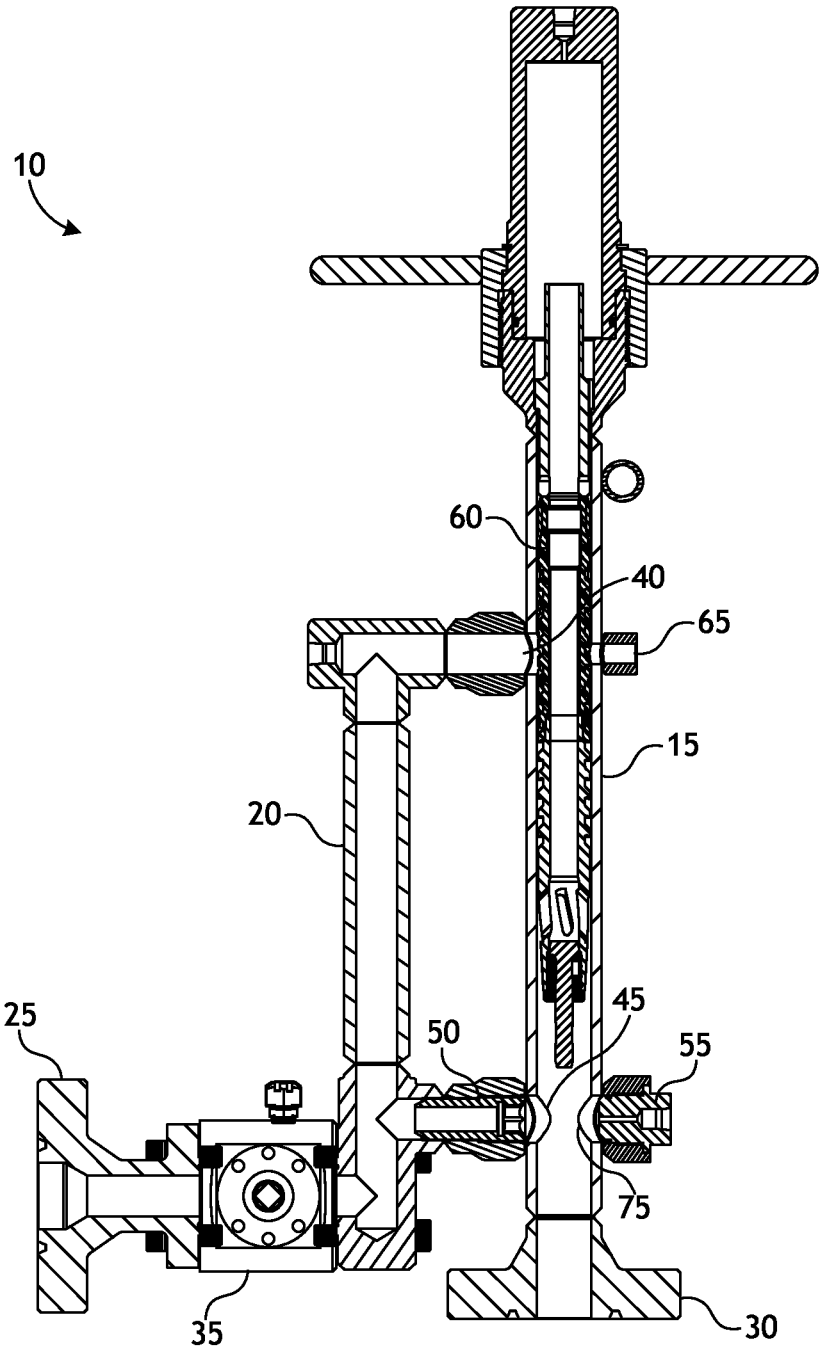
FIG. 3 is a cross section of FIG. 2 along cross section line A-A in FIG. 2.

FIG. 3 is a cross section of FIG. 2 along cross section line A-A in FIG. 2. FIG. 3 better shows other exemplary components and various exemplary flow paths of this particular embodiment of the invention. Namely, FIG. 3 shows upper exit bore 40, lower exit bore 45, orifice 50, and plug 55. Those skilled in the art will appreciate the operation of the various flow paths. For example, it will be appreciated that flow from the well enters the bore in inlet flange 30, travels up the bore of body 15, and exits the bore of body 15 at upper exit bore 40 and/or lower exit bore 45. Flow that traverses both upper exit bore 40 and lower exit bore 45 then flows into the bore of exit flow path 20 and then through exit valve 35 (assuming it is open) and out the bore of outlet flange 25. Accordingly, lubricator 10 can shut in the well by closing only exit valve 35.

Orifice 50 can be a removable orifice such as via a threaded connection in lower exit bore 45. Exemplary details of orifice 50 are described in more detail below in connection with FIGS. 13-18. Orifice 50 is sized to limit the flow through lower exit bore 45 while also creating a region of higher pressure in the vicinity of lower exit bore 45 relative to the pressure in the vicinity of upper exit bore 40, with one purpose of creating this pressure differential between the two regions being to maintain artificial lift device 60 generally in the position shown in FIG. 3. As will be appreciated by those skilled in the art, this pressure differential can be adjusted by using orifices having different bore sizes, or even merely by using bores 40 and 45 of different sizes.

The position in which artificial lift device 60 is maintained is preferably a position (as shown) that does not block flow through lower exit bore 45. By maintaining artificial lift device 60 in its preferred position in lubricator 10, an operator can avoid using catcher 65 to otherwise maintain artificial lift device 60 in is preferred position, as well as any other timing or other processes necessary to activate and deactivate catcher 65. While no orifice is shown in upper exit bore 40, one could be used there as well for the purpose of controlling flow through upper exit bore 40 and/or the pressure in the vicinity of upper exit bore 40 and/or to further establish a desired pressure differential in the lubricator bore between at least upper exit bore 40 and lower exit bore 45. Those skilled in the art will appreciate that artificial lift device 60 can be any artificial lift device including plungers. One advantage to this particular arrangement of components is that, during well operation, artificial lift device 60 can be maintained in its preferred location in lubricator 10 and the well can be shut in via a single valve, such as exit valve 35, used on or in connection with the lubricator.

Another advantage of this particular arrangement of components, aside from its functionality as described above, is the fact that it can be arranged to comply with all applicable API specifications. For example, the distance between the centerline for the bore of body 15 and outlet flange 25 can be manufactured to be API complaint. Those skilled in the art will be familiar with the API specifications for such lubricators and related equipment.

FIG. 3 also shows orifice access port 75 and plug 55. Orifice access port 75 may be used to access lower exit bore 45 for inserting and/or removing orifice 50. Plug 55 is used to seal lower access port 75. Exemplary details of plug 55 are described in more detail below in connection with FIGS. 19-24.

Figure 4:
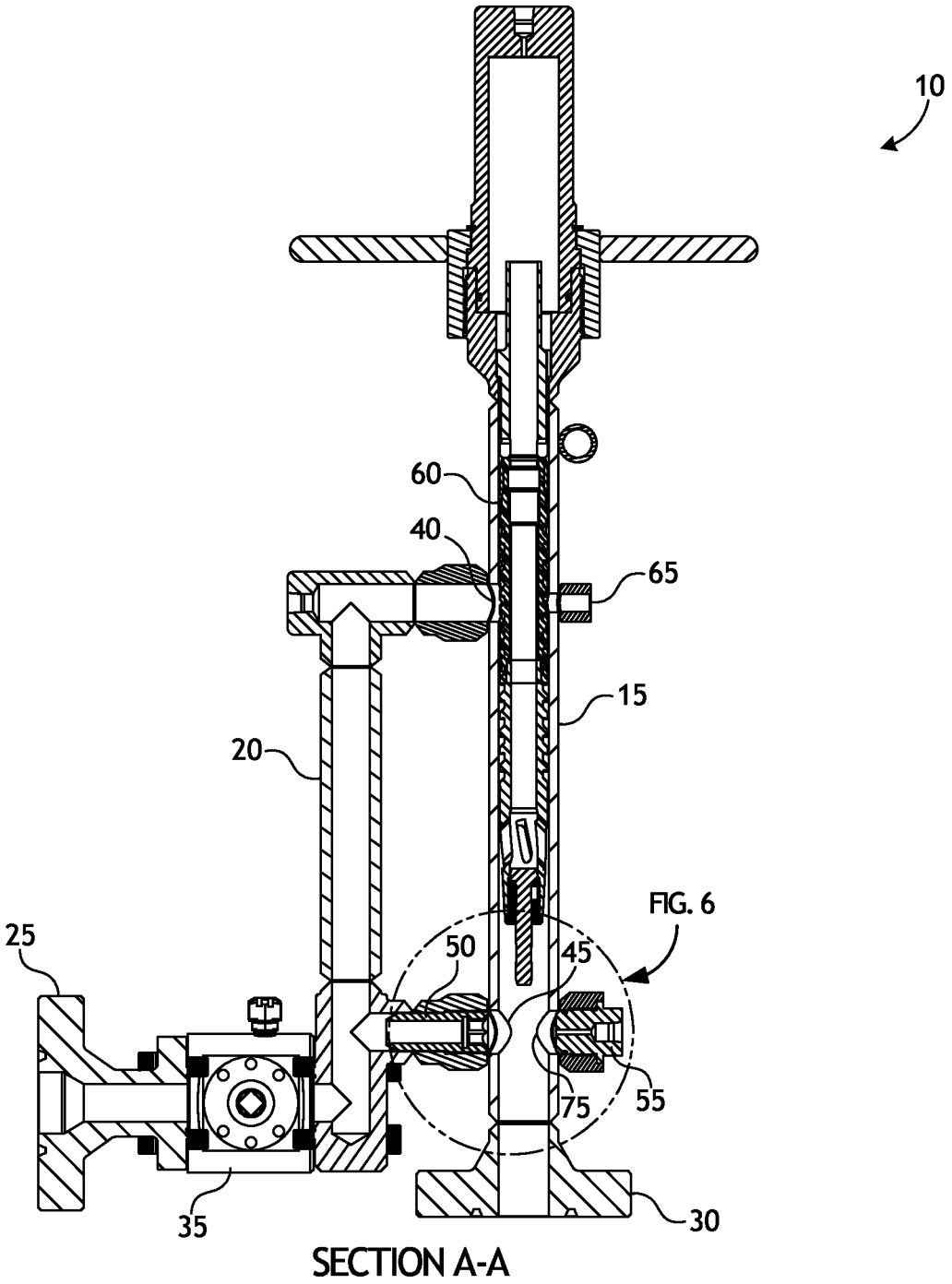
FIG. 4 is a cross section of FIG. 2 along cross section line A-A in FIG. 2, including highlighted area shown in more detail in FIG. 6.
Figure 5:
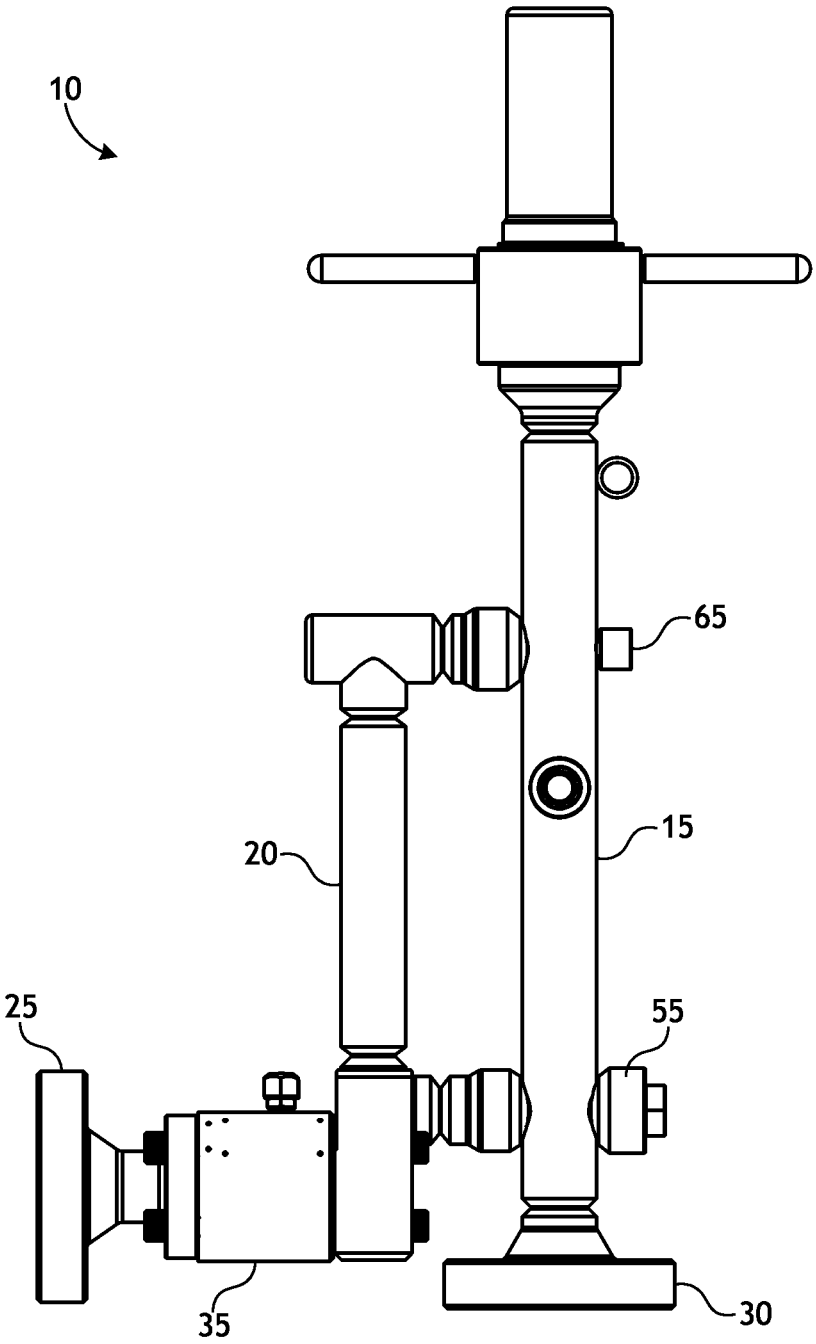
FIG. 5 is a left side view of one embodiment including the present invention.
Figure 6:
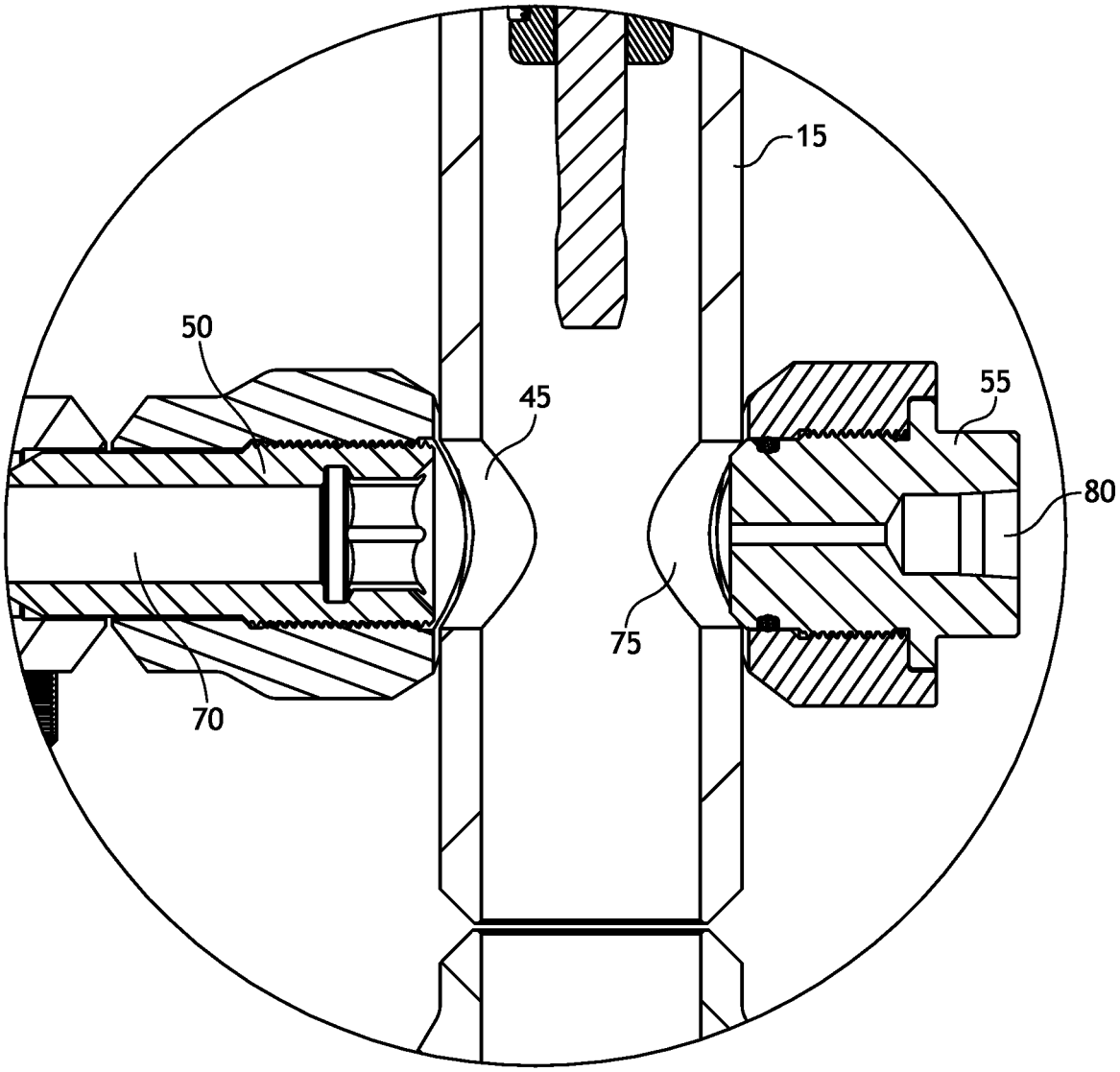
FIG. 6 is a view of the highlighted area of FIG. 4.

FIG. 4 is a cross section of FIG. 2 along cross section line A-A in FIG. 2, including highlighted area shown in more detail in FIG. 6. FIG. 5 is a left side view of an embodiment of lubricator 10.

FIG. 6 is a view of the highlighted area of FIG. 4. FIG. 6 better shows an exemplary embodiment of how orifice 50 is inserted into lower exit bore 45. As shown in this particular embodiment, orifice 50 is maintained in lower exit bore 45 via a threaded connection. Those skilled in the art will appreciate that other connections are possible and within the spirit and scope of the present invention. Likewise, this particular embodiment illustrates that access to lower exit bore 45 (and orifice 50) is provided via orifice access port 75. In other words, orifice access port 75 may be a port or bore in lubricator body 15 through which orifice 50 can be inserted for installation in lower exit port 45. In this particular embodiment, orifice access port 75 can be closed (or sealed) via plug 55, which in this embodiment is via a threaded connection. As also shown in FIG. 6, plug 55 may have an internal access port or bore 80, to which may be coupled a measuring instrument or the like to measure conditions inside lubricator 10 in the vicinity of orifice access port 75. Those skilled in the art will appreciate that plug 55 may be attached to lubricator body 15 (and orifice access port 75) in manners other than a threaded connection. Thus, in this manner orifice 50 may be interchanged with another or different orifice, perhaps having a different size orifice bore 70 so as to adjust the above-described pressure differential between lower exit port 45 and upper exit port 40 and/or or to otherwise control the flow through lower exit port 45.

Figure 7:
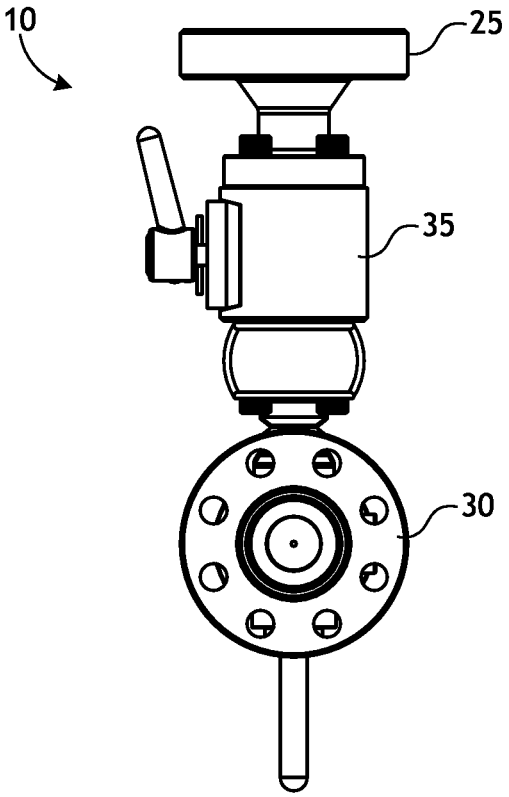
FIG. 7 is a bottom view of one embodiment including the present invention.
Figure 8:
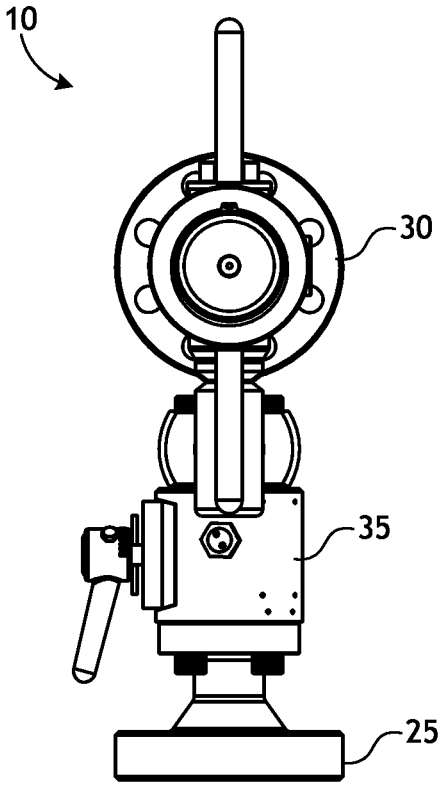
FIG. 8 is a top view of one embodiment including the present invention.
Figure 9:
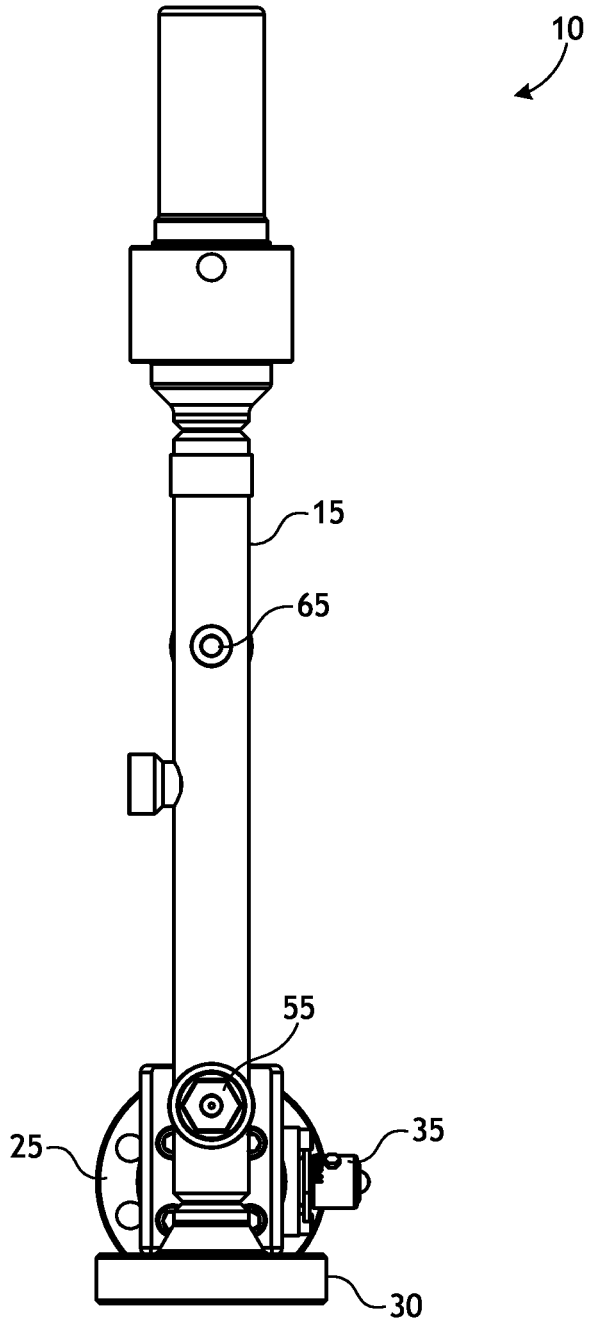
FIG. 9 is a back view of one embodiment including the present invention.
Figure 10:
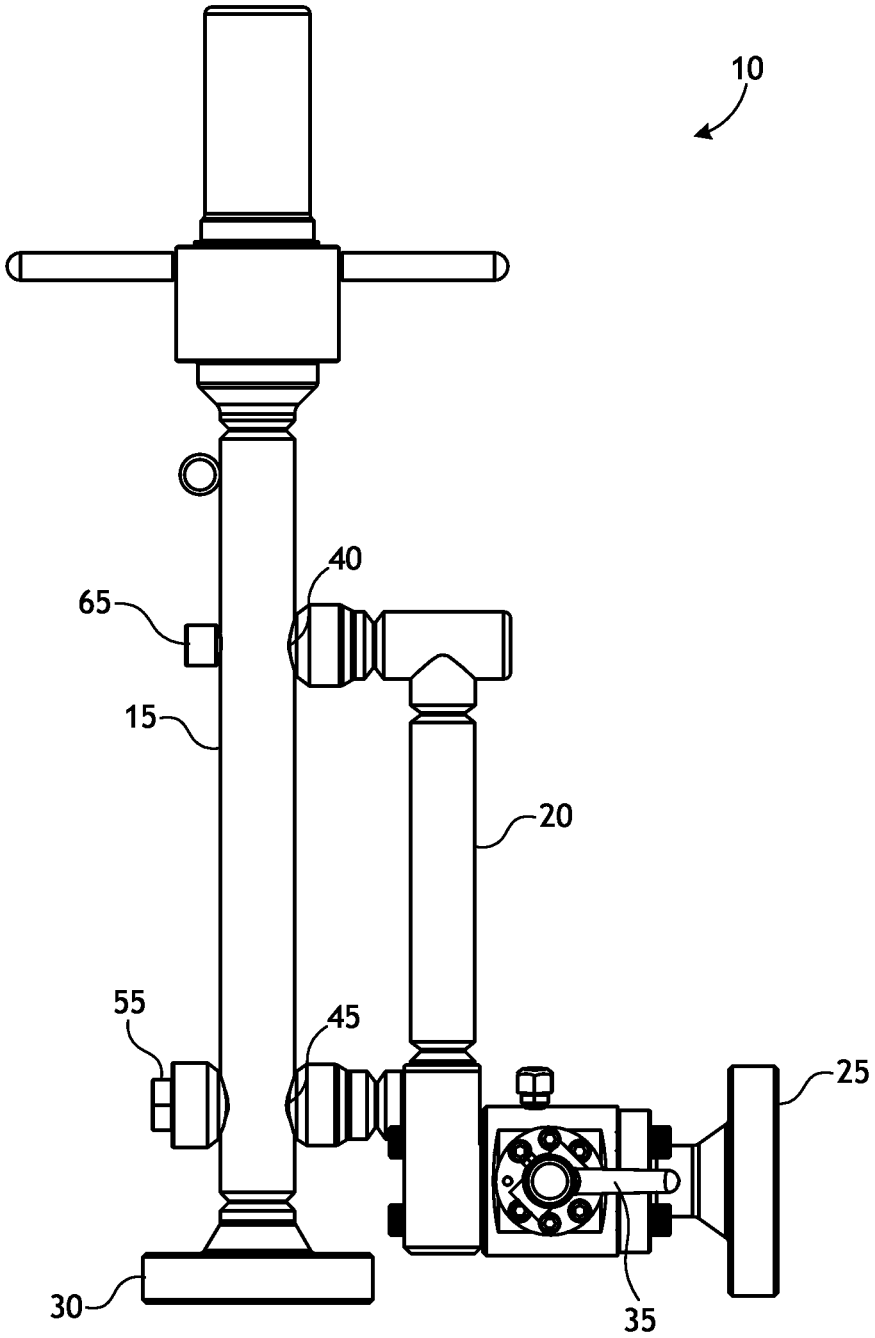
FIG. 10 is a right side view of one embodiment including the present invention.
Figure 11:
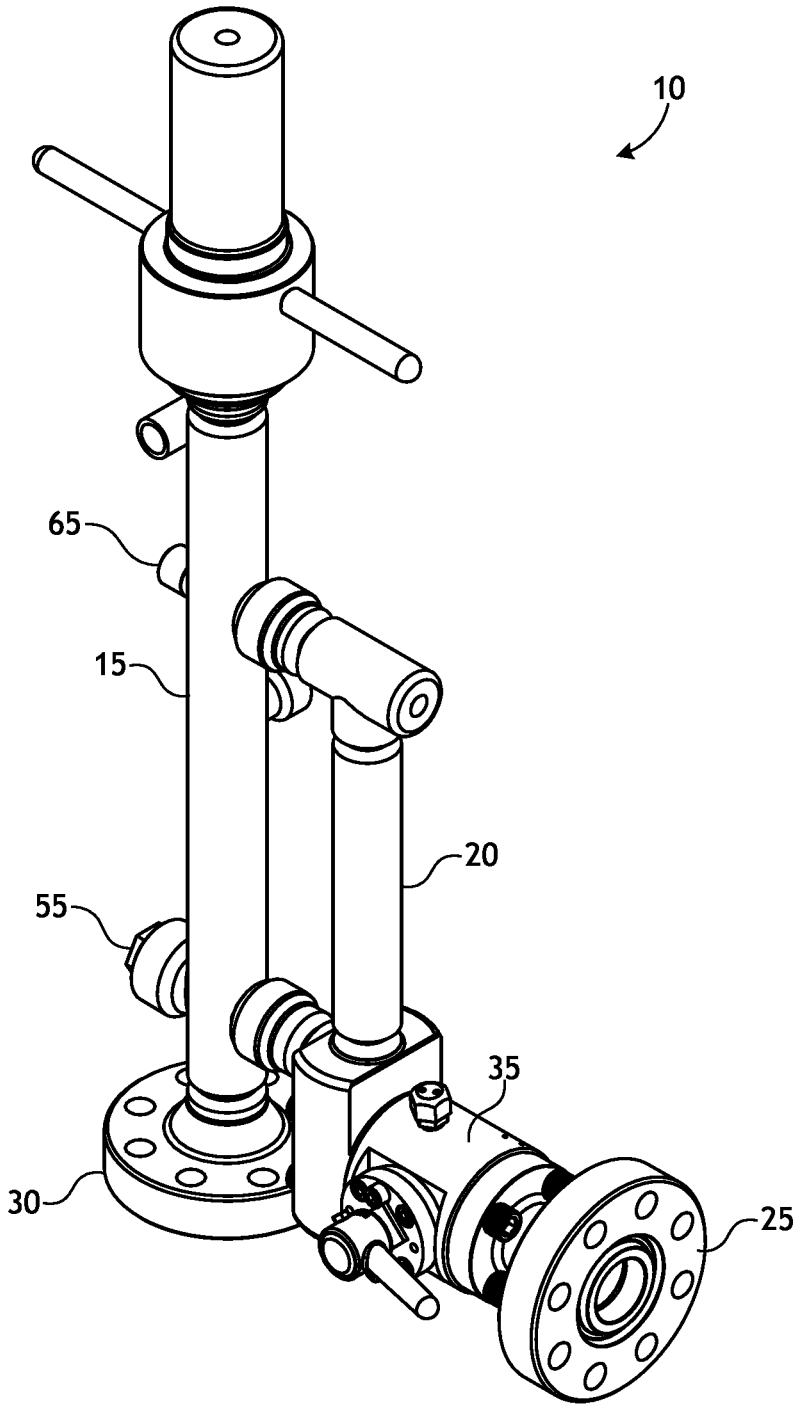
FIG. 11 is a right side perspective view of one embodiment including the present invention.
Figure 12:
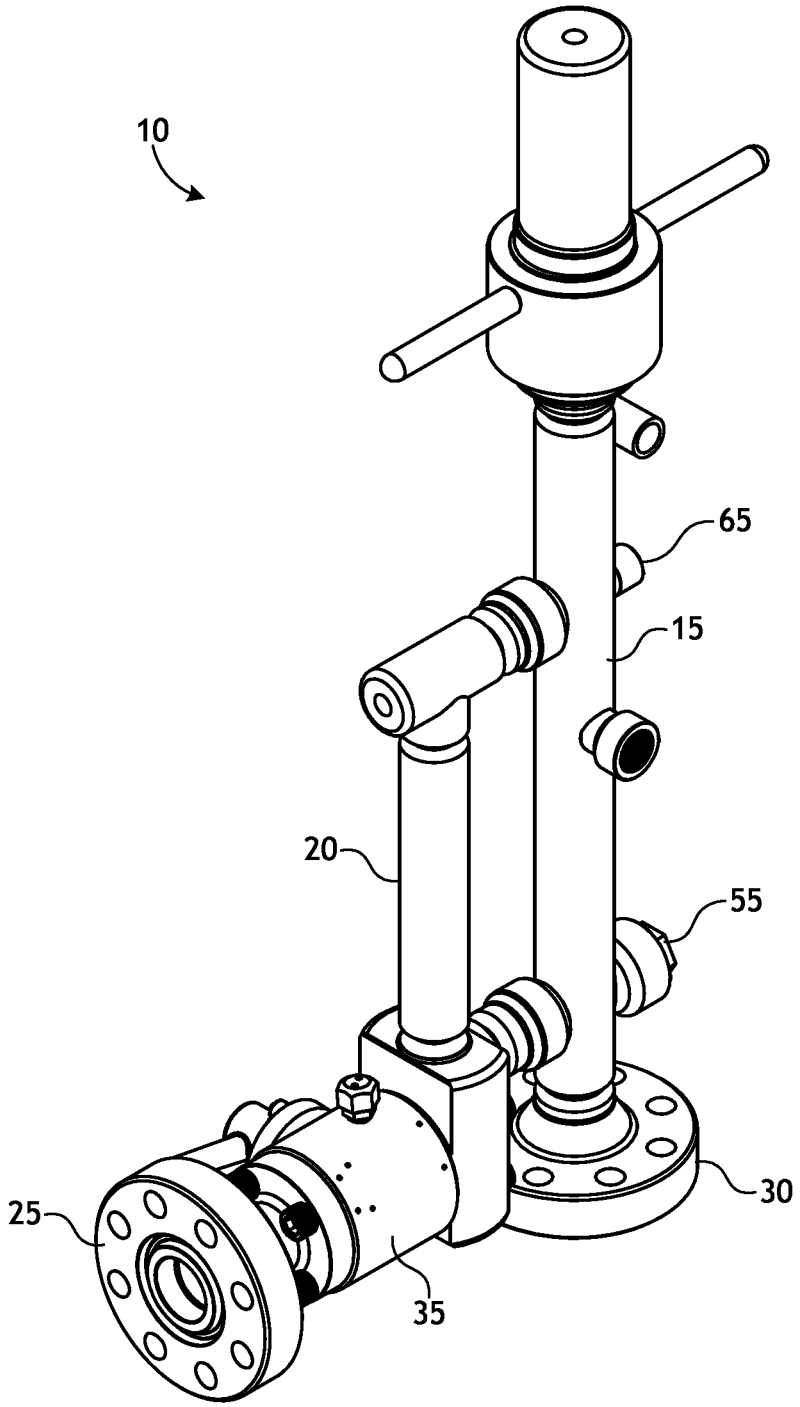
FIG. 12 is a left side perspective view of one embodiment including the present invention.

FIG. 7 is a bottom view of one embodiment including the present invention, and FIG. 8 is a top view of one embodiment including the present invention. FIG. 9 is a back view of one embodiment including the present invention, and FIG. 10 is a right side view of one embodiment including the present invention. FIG. 11 is a right side perspective view of one embodiment including the present invention, and FIG. 12 is a left side perspective view of one embodiment including the present invention.

Figure 13:
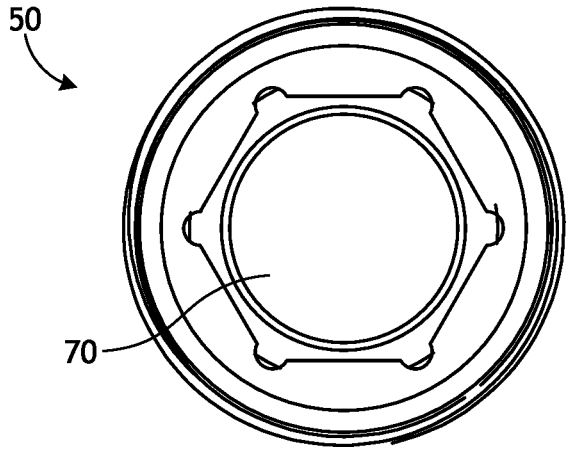
FIG. 13 is a front view of one embodiment of a component of the present invention.
Figure 14:
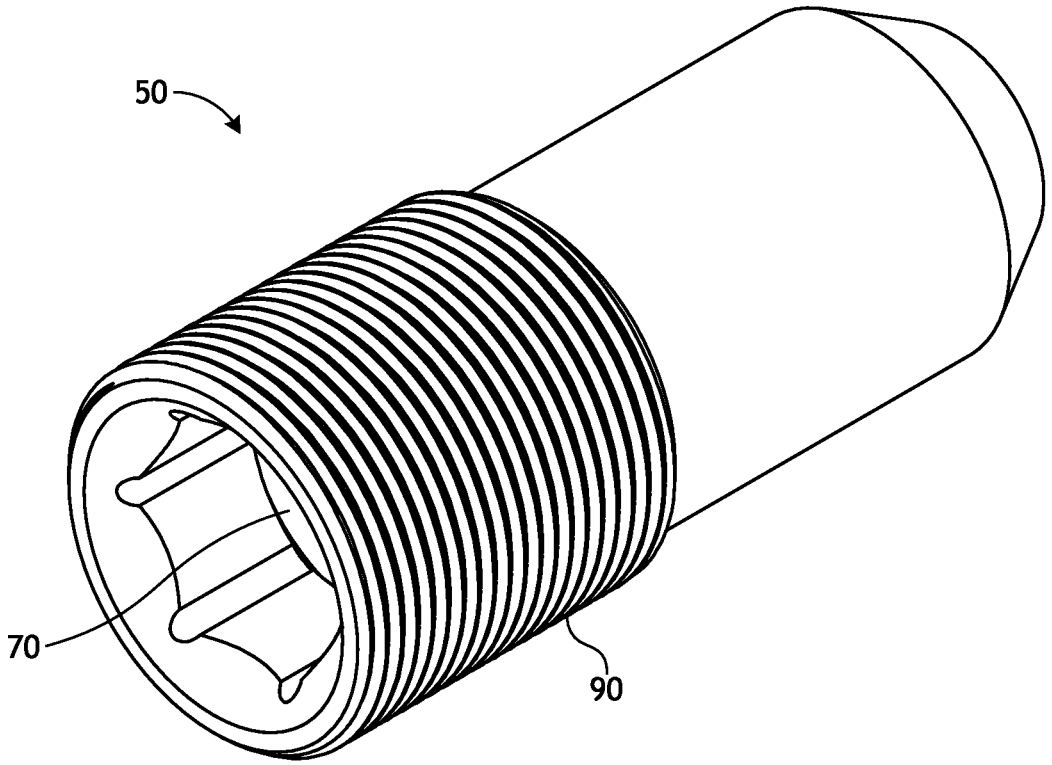
FIG. 14 is a right side perspective view of one embodiment of a component of the present invention.
Figure 15:
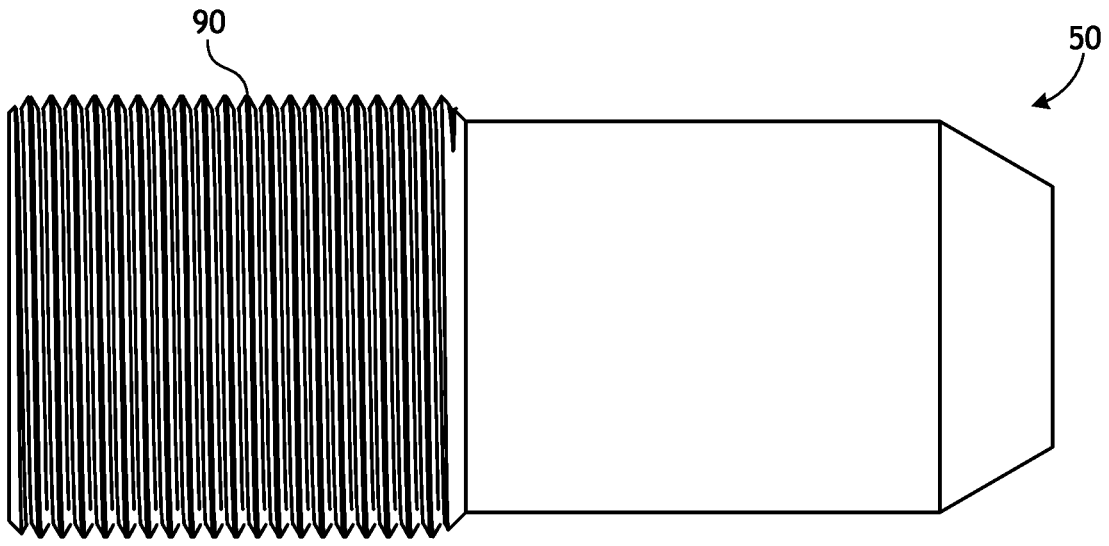
FIG. 15 is a right side view of one embodiment of a component of the present invention.
Figure 16:
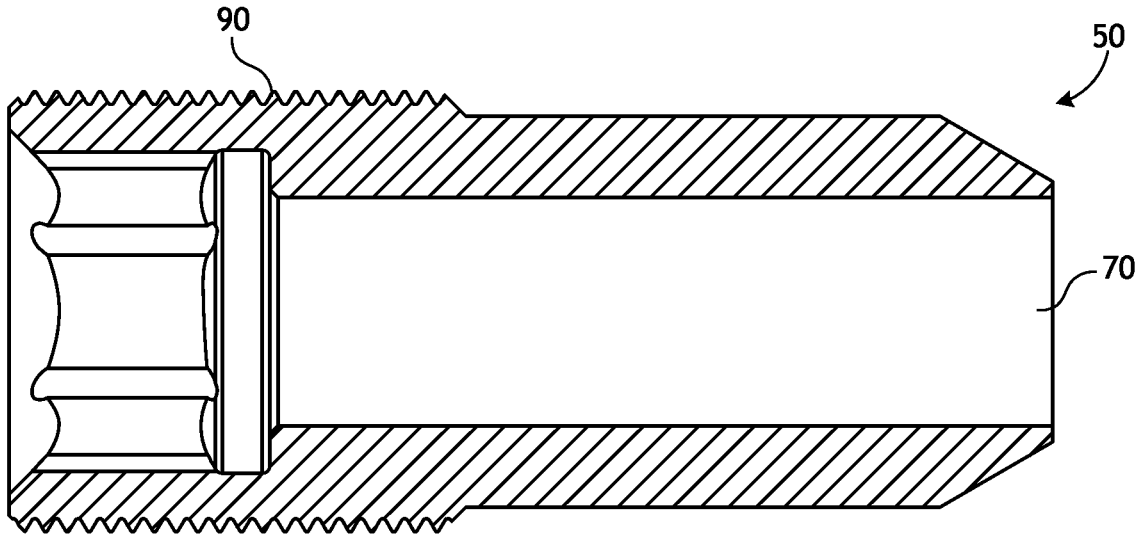
FIG. 16 is a cross section view of one embodiment of a component of the present invention.
Figure 17:
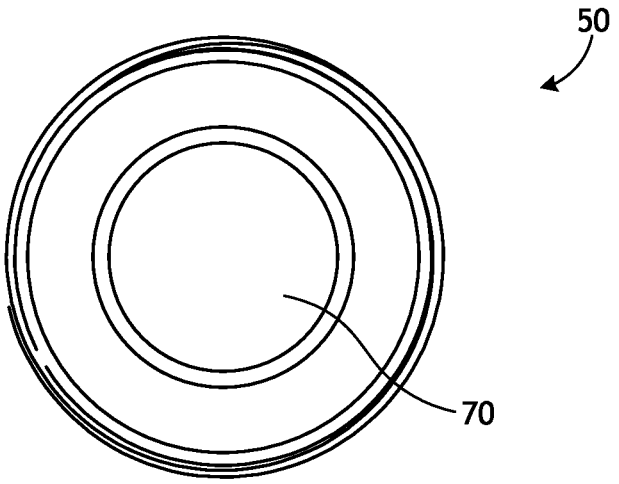
FIG. 17 is a back view of one embodiment of a component of the present invention.
Figure 18:
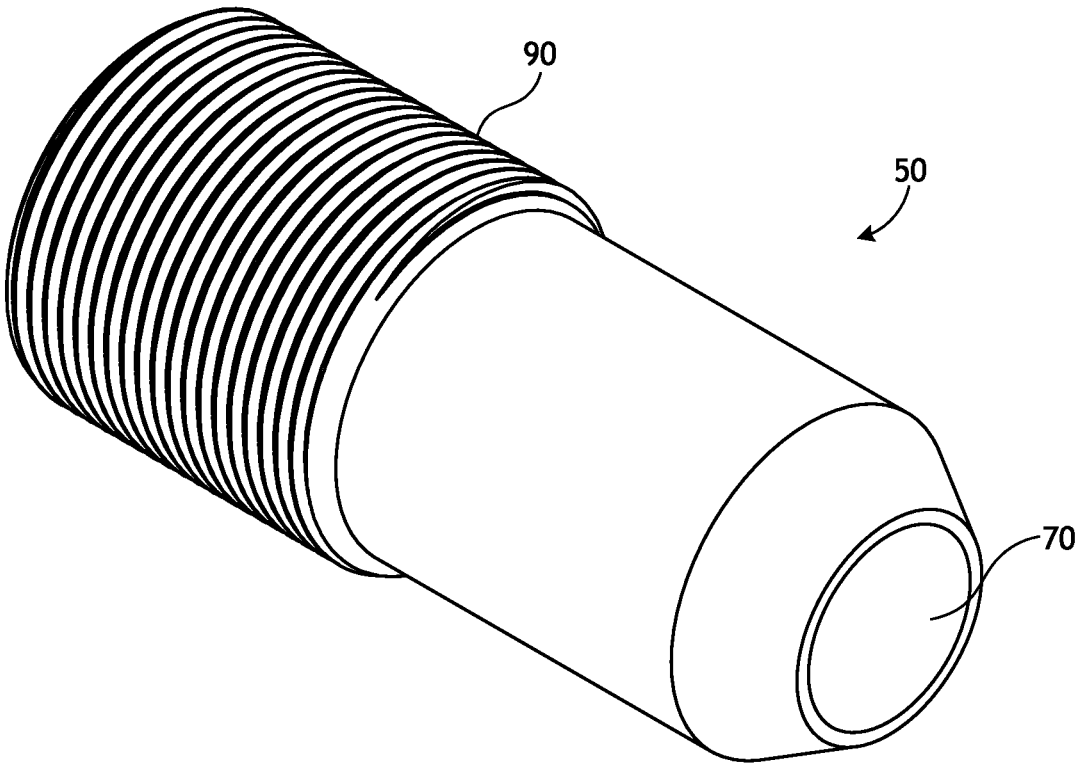
FIG. 18 is a perspective view of one embodiment of a component of the present invention.

FIG. 13 is a front view of one embodiment of a component of the present invention, namely an exemplary embodiment of orifice 50. FIG. 14 is a right side perspective view of orifice 50, whereas FIG. 15 is a right side view of orifice 50. FIG. 16 is a cross section view of orifice 50. FIG. 17 is a back view of orifice 50, and FIG. 18 is a perspective view of orifice 50. In each of one or more of FIGS. 13-18, orifice 50 is shown having a bore 70 and threads 90. Bore 70 is the same bore illustrated in FIG. 6, which is a bore in which flow from the well travels via lower exit bore 45.

As explained above, bore 70 can take on any number of inside diameters, the selection of which may depend on well conditions and/or the specific artificial lift device used. Indeed, in this embodiment the orifice is made to be interchangeable so that orifices of different bore size can be readily interchanged in order to accommodate the operational parameter(s) of the lubricator desired by the well operator. In that context, as also described above, orifice 50 may be maintained in lower exit bore 45 via threads 90 so that the orifice can be readily inserted/removed from the lubricator via orifice access port 75. Those skilled in the art will appreciate that mechanisms other than threads can be used to retain orifice 50 in the lubricator.

Figure 19:
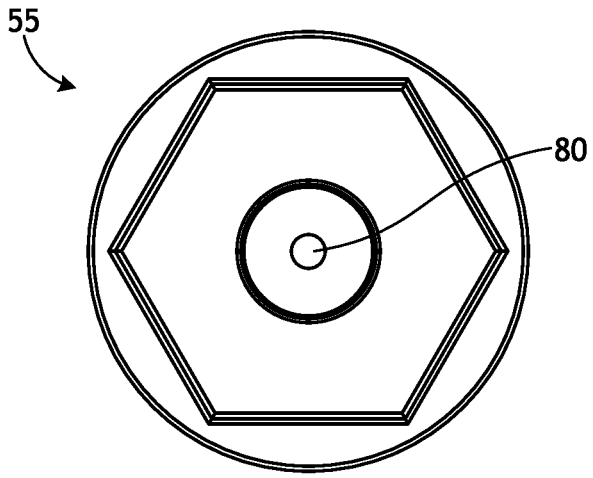
FIG. 19 is a top view of one embodiment of a component of the present invention.
Figure 20:
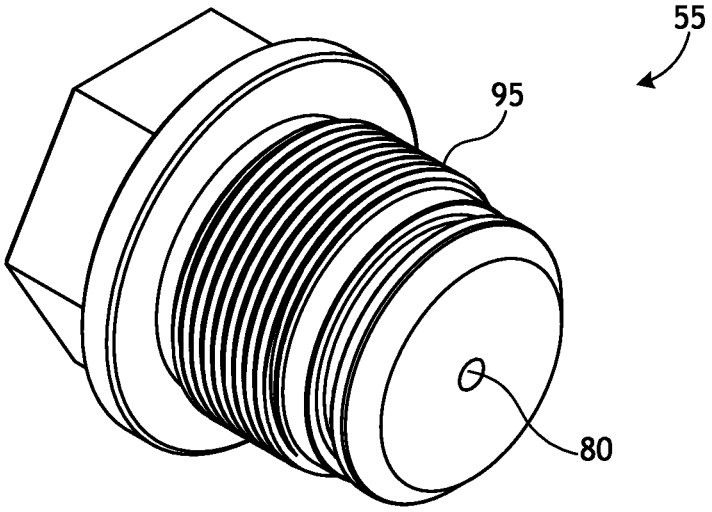
FIG. 20 is a right side perspective view of one embodiment of a component of the present invention.
Figure 21:
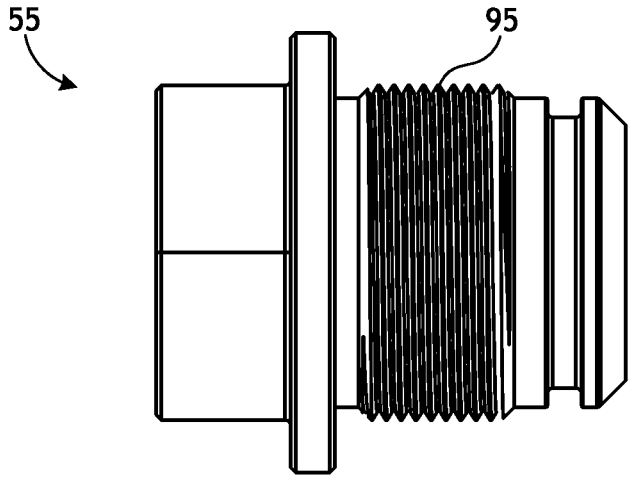
FIG. 21 is a right side view of one embodiment of a component of the present invention.
Figure 22:
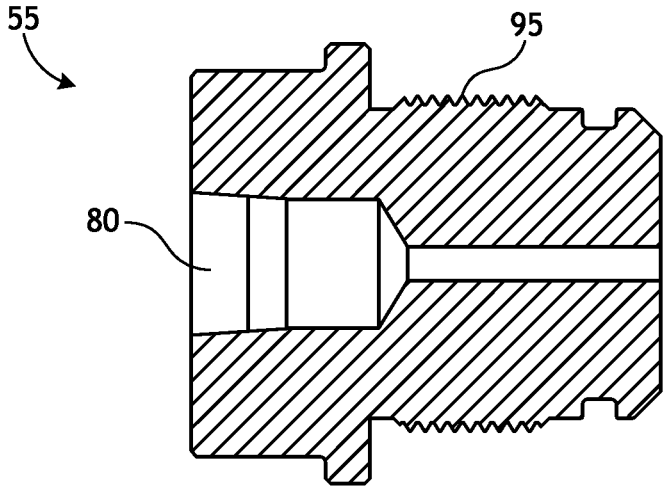
FIG. 22 is a cross section view of one embodiment of a component of the present invention.
Figure 23:
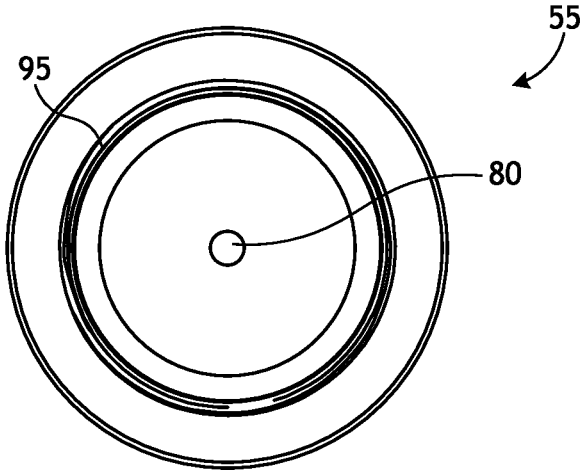
FIG. 23 is a bottom view of one embodiment of a component of the present invention.
Figure 24:
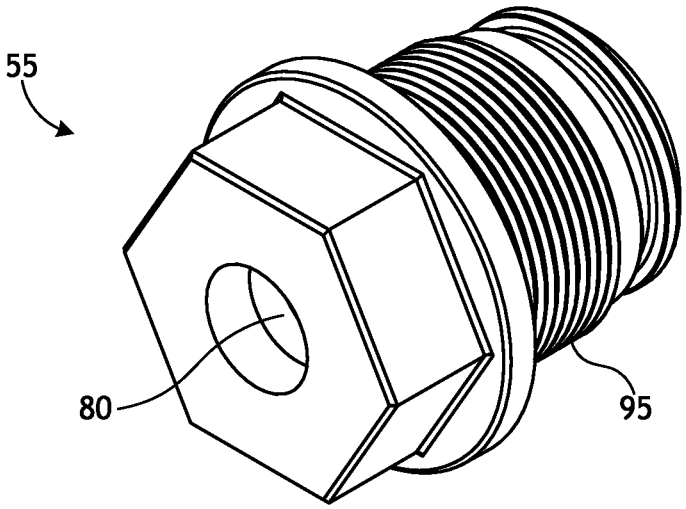
FIG. 24 is a perspective view of one embodiment of a component of the present invention.

FIG. 19 is a top view of one embodiment of a component of the present invention, namely an exemplary embodiment of plug 55. FIG. 20 is a right side perspective view of an embodiment of plug 55, whereas FIG. 21 is a right side view of plug 55. FIG. 22 is a cross section view of plug 55. FIG. 23 is a bottom view of an embodiment of plug 55. FIG. 24 is a perspective view of an embodiment of plug 55. In each of one or more of FIGS. 19-24, plug 55 is shown having plug port or bore 80 and threads 95. As explained above, threads 95 serve to maintain plug 55 in sealed connection with lubricator 10, but those skilled in the art will appreciate that other connection means are within the spirit and scope of the present invention. Plug bore 80 is also discussed above and, while not mandatory, its presence gives the user the option of connecting instrumentation to test conditions internal to the lubricator. Plug 55 is sized to seal orifice access port 75, and orifice access port 75 is sized to receive there-through orifice 50 for installation/removal from lower exit port 45.

Figure 25:
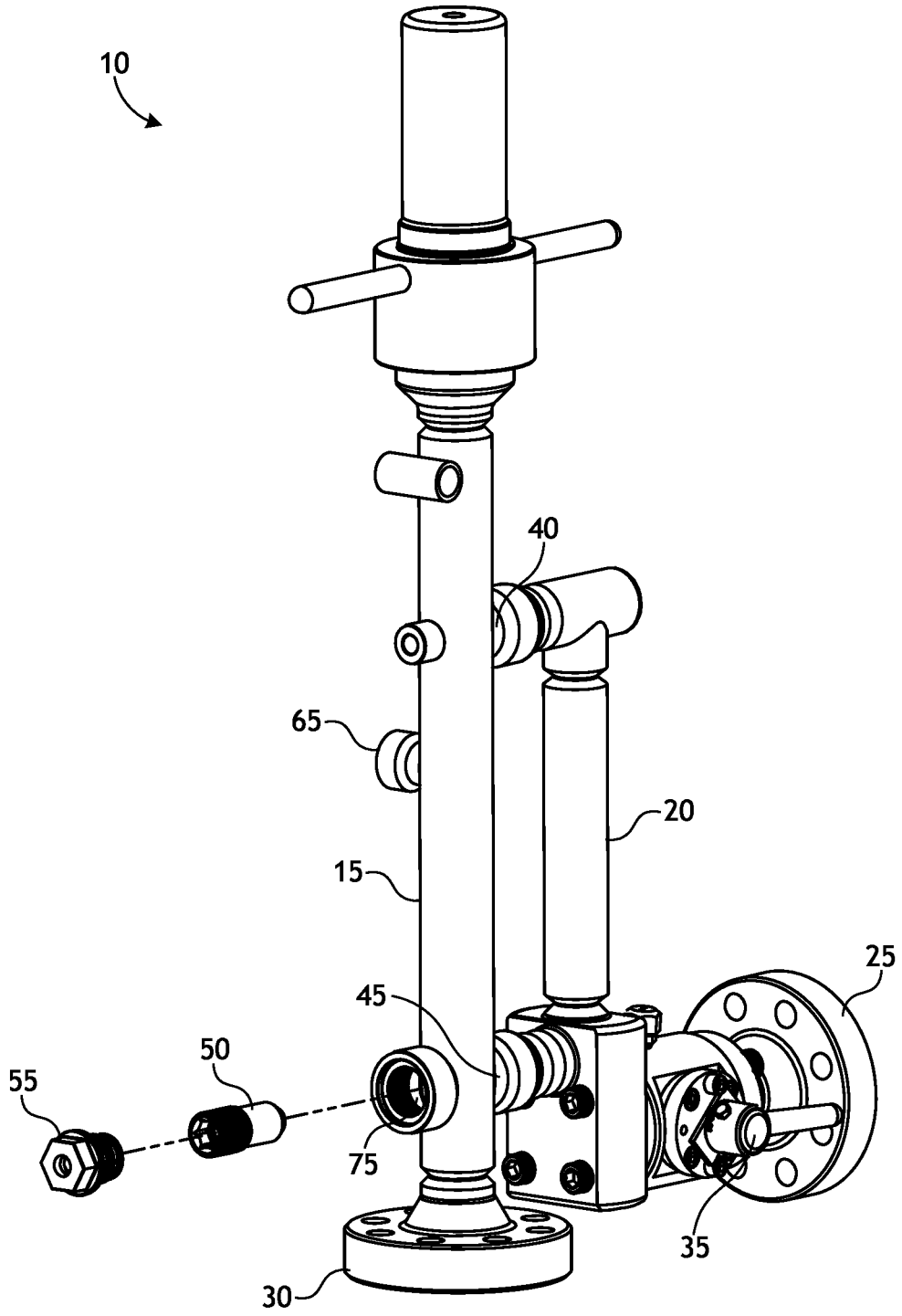
FIG. 25 is a left side partial assembly view of one embodiment including the present invention.

FIG. 25 is a left side partial assembly view of one embodiment including the present invention. As shown, orifice 50 can be inserted into orifice access port 75, across the bore of body 15, and threaded into lower exit port 45. Thereafter, plug 55 is secured into lubricator 10 so as to orifice access port 75. Operation of the combination shown in FIG. 25 is as described above in connection with FIG. 3.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A lubricator for use with a well, the lubricator comprising:

a body having a first bore through which gas from the well travels, wherein the first bore includes at least an upper exit bore for gases traveling through the first bore and a lower exit bore for gases traveling through the first bore, wherein the lower exit bore includes a removable orifice having a bore and the orifice is removable through an orifice access port in the body;

an exit flow path having a second bore, wherein the second bore is in fluid communication with the upper exit bore, the lower exit bore, and an exit valve;

wherein the second bore includes an output for delivering gas received through the upper exit bore and through the lower exit bore to the exit valve;

the upper exit bore and the lower exit bore sized relative to one another to create a pressure differential between the upper exit bore and the lower exit bore; and the exit valve having an open and a closed position such that gas will flow through the exit valve when it is in its open position and gas will not flow through the exit valve when it is in its closed position;

wherein the lubricator shuts in the well when the exit valve is in its closed position.

2. The lubricator of claim 1 wherein the pressure differential between the upper exit bore and the lower exit bore is sufficient to maintain an artificial lift device in the first bore.

3. The lubricator of claim 2 wherein the lower exit bore and the orifice bore are the same bore.

4. The lubricator of claim 3 wherein the orifice access port is located on a side of the body opposite the lower exit bore.

5. The lubricator of claim 4 wherein the orifice access port includes a plug for sealing the orifice access port.

6. The lubricator of claim 5 further including an output flange connected to the exit valve.

7. The lubricator of claim 6 further including an inlet flange for connecting to a wellhead.

8. The lubricator of claim 7 wherein the body includes a centerline through the first bore and wherein the distance between the centerline of the first bore and the output flange is API complaint.

9. The lubricator of claim 8 wherein the pressure differential between the upper exit bore and the lower exit bore is sufficient to maintain an artificial lift device in the first bore above the lower exit bore.

10. A lubricator for use with a well, the lubricator comprising:

a body having a first bore through which gas from the well travels, wherein the first bore includes at least an upper exit bore for gases traveling through the first bore and a lower exit bore for gases traveling through the first bore, wherein at least the upper exit bore or the lower exit bore includes an orifice removable through an orifice access port in the body;

an exit flow path having a second bore, wherein the second bore is in fluid communication with the upper exit bore, the lower exit bore, and an exit valve;

the upper exit bore and the lower exit bore sized relative to one another to create a pressure differential between the upper exit bore and the lower exit bore; and the exit valve having an open and a closed position such that gas will flow through the exit valve when it is in its open position and gas will not flow through the exit valve when it is in its closed position;

wherein the lubricator shuts in the well when the exit valve is in its closed position.

11. The lubricator of claim 10 wherein the orifice access port includes a plug for sealing the orifice access port.

12. The lubricator of claim 11 further including an output flange connected to the exit valve.

13. The lubricator of claim 12 further including an inlet flange for connecting to a wellhead.

14. The lubricator of claim 13 wherein the body includes a centerline through the first bore and wherein the distance between the centerline of the first bore and the output flange is API complaint.

15. The lubricator of claim 14 wherein the pressure differential between the upper exit bore and the lower exit bore is sufficient to maintain an artificial lift device in the first bore above the lower exit bore.

16. A lubricator for use with a well, the lubricator comprising:

a body having a first bore through which gas from the well travels, wherein the first bore includes at least an upper exit bore for gases traveling through the first bore and a lower exit bore for gases traveling through the first bore, wherein at least the upper exit bore or the lower exit bore includes an orifice removable through an orifice access port in the body;

an exit flow path having a second bore, wherein the second bore is in fluid communication with the upper exit bore, the lower exit bore, and an exit valve;

the upper exit bore and the lower exit bore sized relative to one another to create a pressure differential between the upper exit bore and the lower exit bore; and the exit valve having an open and a closed position such that gas will flow through the exit valve when it is in its open position and gas will not flow through the exit valve when it is in its closed position.

17. The lubricator of claim 16 wherein the orifice access port includes a plug for sealing the orifice access port.

18. The lubricator of claim 17 further including an output flange connected to the exit valve.

19. The lubricator of claim 18 further including an inlet flange for connecting to a wellhead.

20. The lubricator of claim 19 wherein the body includes a centerline through the first bore and wherein the distance between the centerline of the first bore and the output flange is API complaint.

21. The lubricator of claim 20 wherein the pressure differential between the upper exit bore and the lower exit bore is sufficient to maintain an artificial lift device in the first bore above the lower exit bore.

22. A lubricator for use with a well, the lubricator comprising:

a body having a first bore through which gas from the well travels, wherein the first bore includes at least an upper exit bore for gases traveling through the first bore and a lower exit bore for gases traveling through the first bore, wherein either the upper exit bore or the lower exit bore includes an orifice removable through an orifice access port in the body;

the upper exit bore and the lower exit bore sized relative to one another to create a pressure differential between the upper exit bore and the lower exit bore;

an exit flow path having a second bore, wherein the second bore is in fluid communication with the upper exit bore, the lower exit bore, and an exit valve; and the exit valve having an open and a closed position such that gas will flow through the exit valve when it is in its open position and gas will not flow through the exit valve when it is in its closed position.

23. The lubricator of claim 22 wherein the orifice access port includes a plug for sealing the orifice access port.

24. The lubricator of claim 23 further including an output flange connected to the exit valve.

25. The lubricator of claim 24 wherein the body includes a centerline through the first bore and wherein the distance between the centerline of the first bore and the output flange is API complaint.

26. The lubricator of claim 22 wherein the orifice is located in the lower exit bore.

27. The lubricator of claim 22 wherein the orifice is located in the upper exit bore.

28. The lubricator of claim 22 wherein the lubricator shuts in the well when the exit valve is in its closed position.

* * * * *